US009871326B2

(12) United States Patent
Zhao et al.

(10) Patent No.: US 9,871,326 B2
(45) Date of Patent: Jan. 16, 2018

(54) CONNECTOR WITH PREFORMED METALLIC TUBULAR MOUNTING BRACKET

(71) Applicant: FOXCONN INTERCONNECT TECHNOLOGY LIMITED, Grand Cayman (KY)

(72) Inventors: Jun Zhao, HuaiAn (CN); Guang-Xin Gu, HuaiAn (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/378,074

(22) Filed: Dec. 14, 2016

(65) Prior Publication Data

US 2017/0170608 A1 Jun. 15, 2017

(30) Foreign Application Priority Data

Dec. 14, 2015 (CN) ..... 2015 1 0921355

(51) Int. Cl.

| | |
|---|---|
| ***H01R 13/658*** | (2011.01) |
| ***H01R 13/6581*** | (2011.01) |
| ***H01R 24/60*** | (2011.01) |
| ***H01R 43/20*** | (2006.01) |
| *H01R 107/00* | (2006.01) |

(52) U.S. Cl.

CPC ..... *H01R 13/6581* (2013.01); *H01R 24/60* (2013.01); *H01R 43/20* (2013.01); *H01R 2107/00* (2013.01)

(58) Field of Classification Search

CPC ..... H01R 13/6581; H01R 13/6594; H01R 13/6595

See application file for complete search history.

(56) References Cited

U.S. PATENT DOCUMENTS

| | | | | |
|---|---|---|---|---|
| 9,461,413 | B2 | 10/2016 | Duan et al. | |
| 2015/0244111 | A1* | 8/2015 | Ju | H01R 13/6585 439/607.05 |
| 2016/0352051 | A1* | 12/2016 | Tsai | H01R 13/6585 |

FOREIGN PATENT DOCUMENTS

| | | |
|---|---|---|
| CN | 204190087 | 3/2015 |
| CN | 204720613 | 10/2015 |

* cited by examiner

*Primary Examiner* — Ross Gushi
(74) *Attorney, Agent, or Firm* — Wei Te Chung; Ming Chieh Chang

(57) ABSTRACT

An electrical connector includes an terminal module and a metallic tubular shield fixedly enclosing the terminal module to form a sub-assembly, and a metallic tubular bracket enclosing the sub-assembly. The terminal module includes an insulator having a base and a tongue portion forwardly extending from the base, and a plurality of terminals disposed in the insulator. The base includes a rear end having a securing section, and the bracket has a fixing section correspondingly, wherein the bracket is adapted to be forwardly assembled from a rear side of the sub-assembly to have the fixing section engaged with the securing section.

18 Claims, 7 Drawing Sheets

CONNECTOR WITH PREFORMED METALLIC TUBULAR MOUNTING BRACKET

BACKGROUND OF THE INVENTION

1. Field of the Invention

The present invention relates to an electrical connector, and particularly to an electrical receptacle connector with a preformed metallic tubular mounting bracket thereof.

2. Description of Related Art

The copending application Ser. No. 15/169,963 having the same assignee with the invention and filed on Jun. 1, 2016, discloses an electrical connector with an insulative housing enclosed within a metallic shield to commonly form a sub-assembly, and further successively assembled forwardly into a metallic tubular bracket which includes a rear wall to be bent to shield the rear side of the sub-assembly. Anyhow, the bending of the rear wall of the bracket costs labor and may incautiously damage the housing of the sub-assembly disadvantageously.

An improved electrical connector without such disadvantages and the corresponding making method are desired.

SUMMARY OF THE INVENTION

An object of the invention is to provide an easy-making and labor-saving method for an electrical connector. The electrical connector includes an terminal module and a metallic tubular shield fixedly enclosing the terminal module to form a sub-assembly, and a metallic tubular bracket enclosing the sub-assembly. The terminal module includes an insulator having a base and a tongue portion forwardly extending from the base, and a plurality of terminals disposed in the insulator.

The base includes a rear end having a securing section, and the bracket has a fixing section correspondingly, wherein the bracket is adapted to be forwardly assembled from a rear side of the sub-assembly to have the fixing section engaged with the securing section. The fixing section includes an L-shaped structure which is adapted to be forwardly assembled upon the securing section in the front-to-back direction. The securing section includes a recess and an abutment wall in front of the recess.

Correspondingly, the bracket includes a top wall, and the fixing section extends downward from the top wall. The recess forms a slanted face along which the fixing section moves. The bracket forms a plurality of mounting legs.

The features of the invention is to have the fixing section preformed before the bracket is mounted upon the sub-assembly and have the fixing section engaged with the securing section after the bracket is moved to its final position where the bracket is welded to the shield accordingly.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
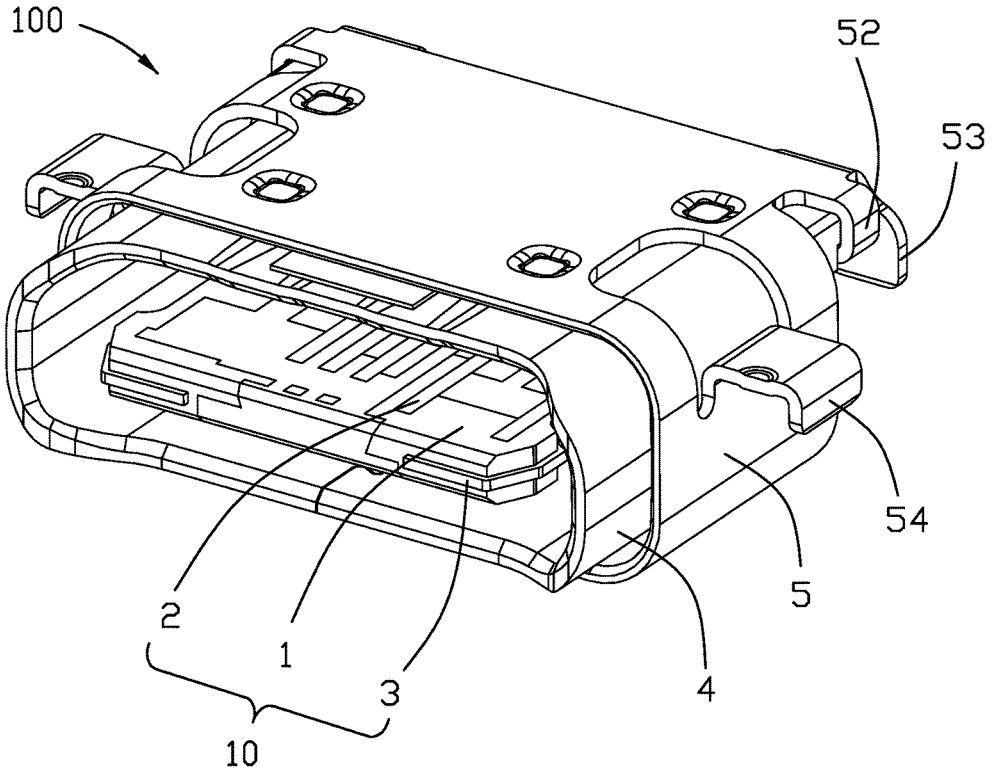
FIG. 1 is a front downward assembled perspective view of an electrical connector according to the presently preferred embodiment of the invention.
Figure 2:
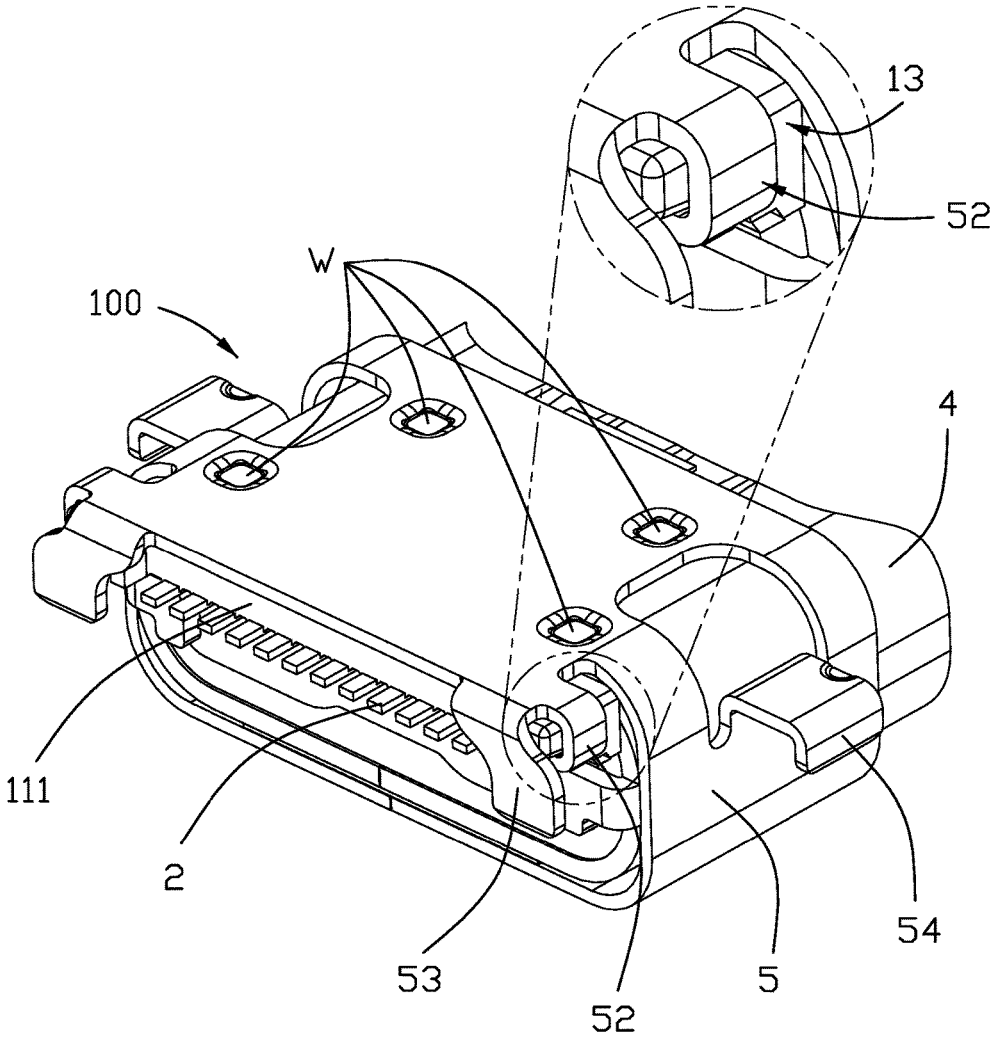
FIG. 2 is a rear downward perspective view of the electrical connector of FIG. 1.
Figure 3:
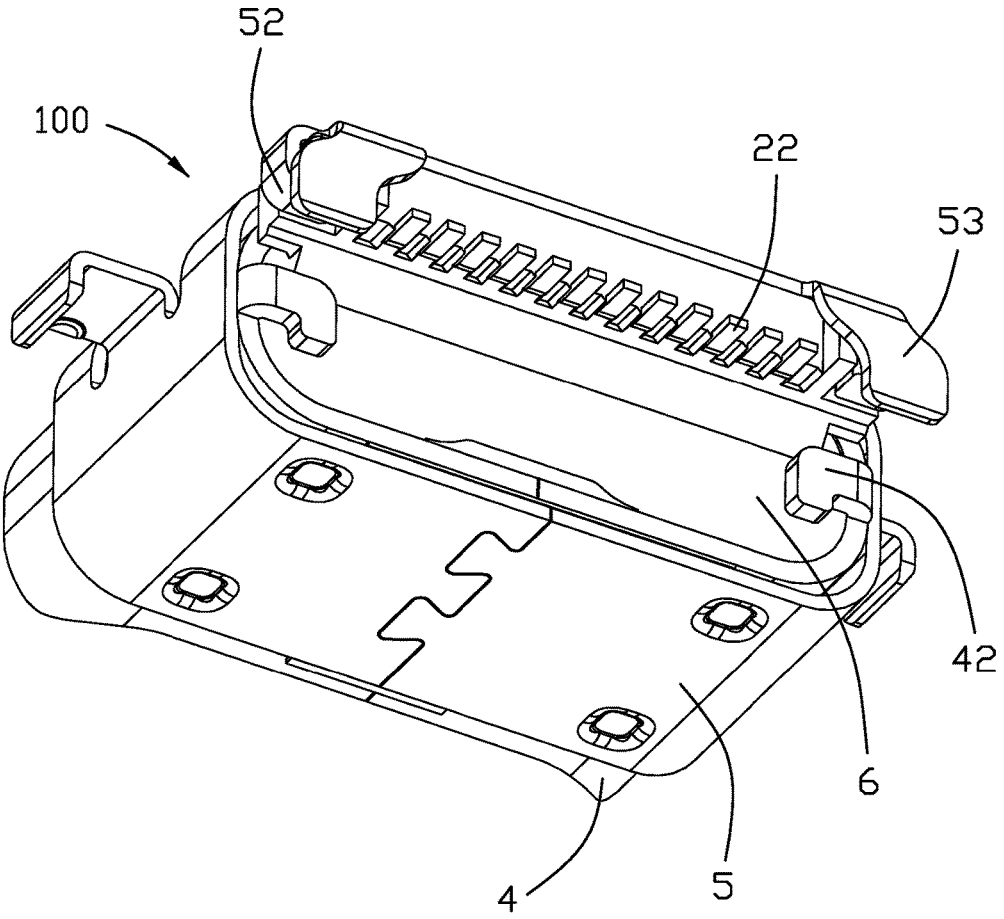
FIG. 3 is a rear upward perspective view of the electrical connector of FIG. 1.
Figure 4:
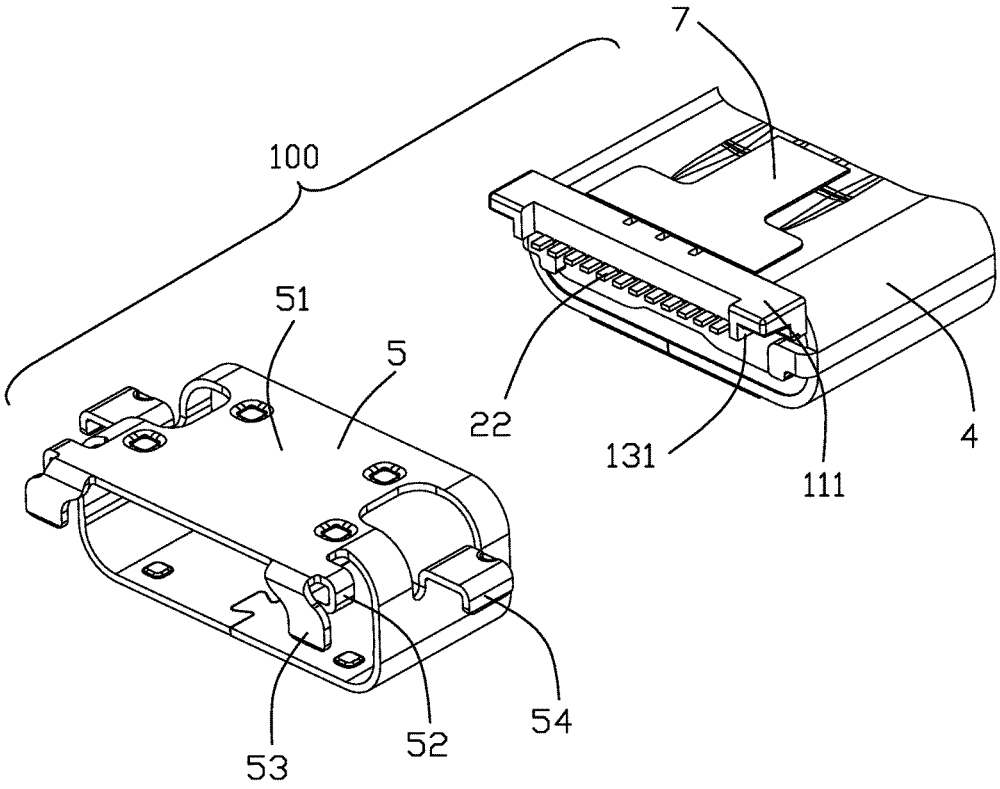
FIG. 4 is a rear downward exploded perspective view of the electrical connector of FIG. 2.
Figure 5:
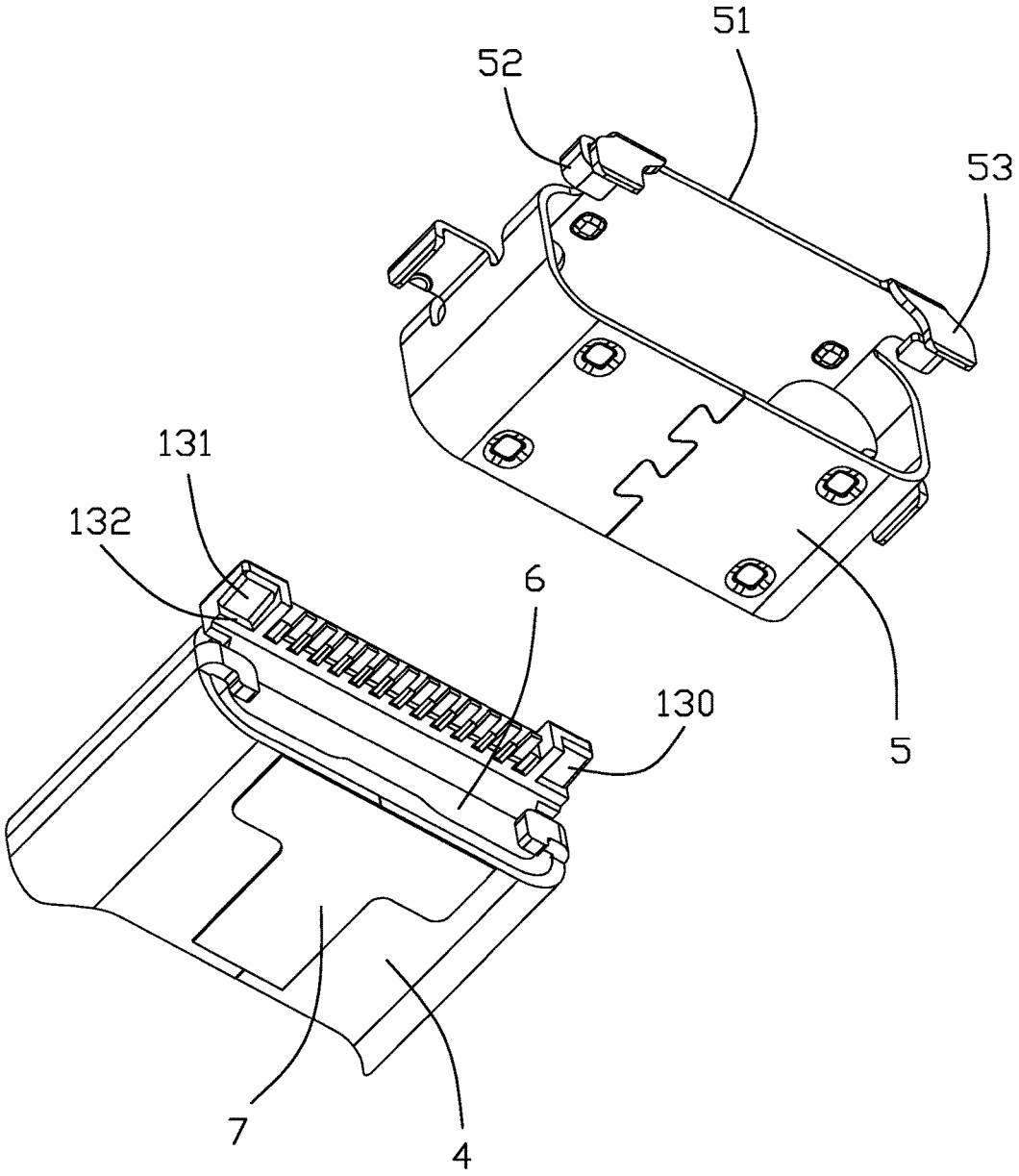
FIG. 5 is a rear upward exploded perspective view of the electrical connector of FIG. 3.
Figure 6:
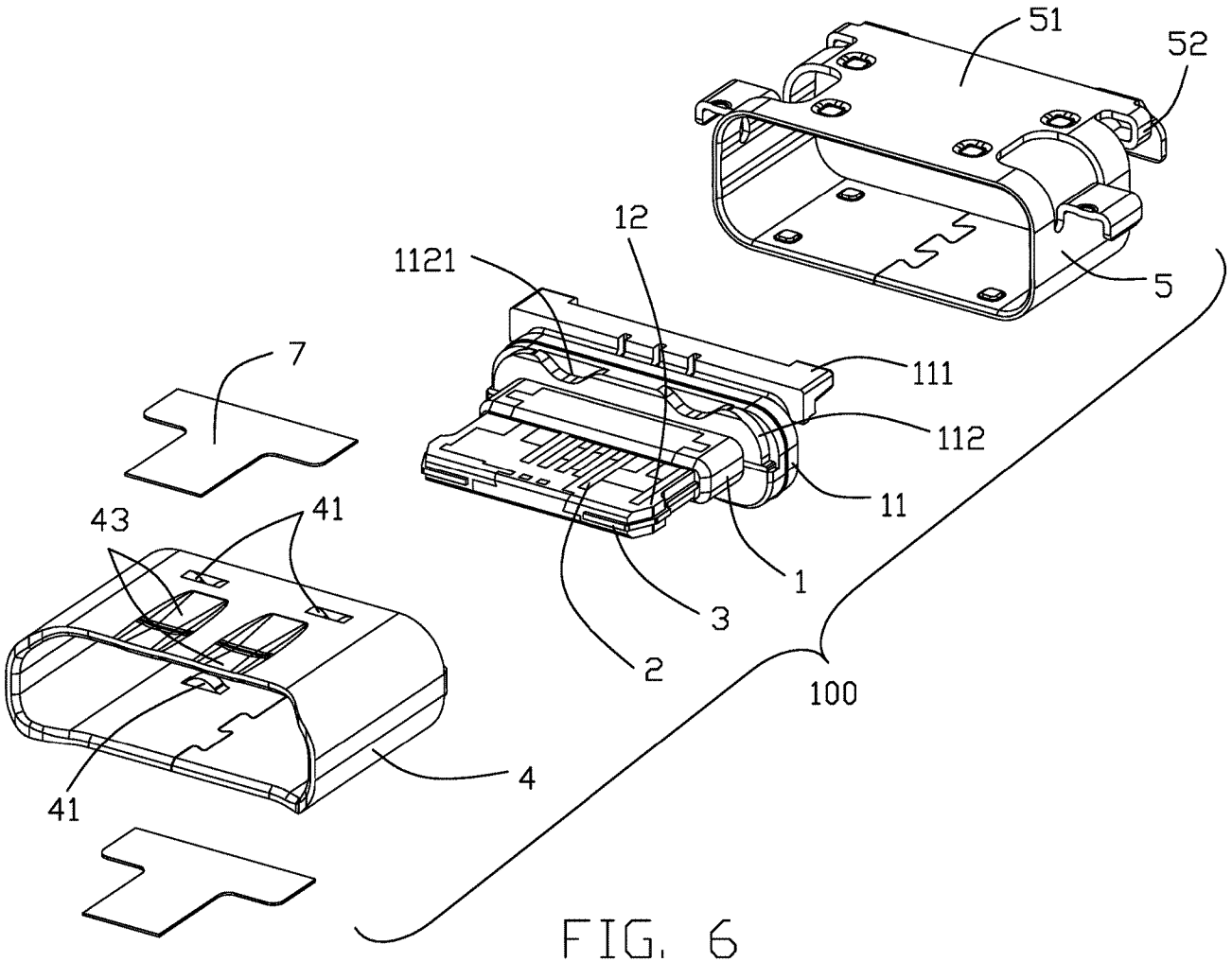
FIG. 6 is a front downward exploded perspective view of electrical connector of FIG. 1.
Figure 7:
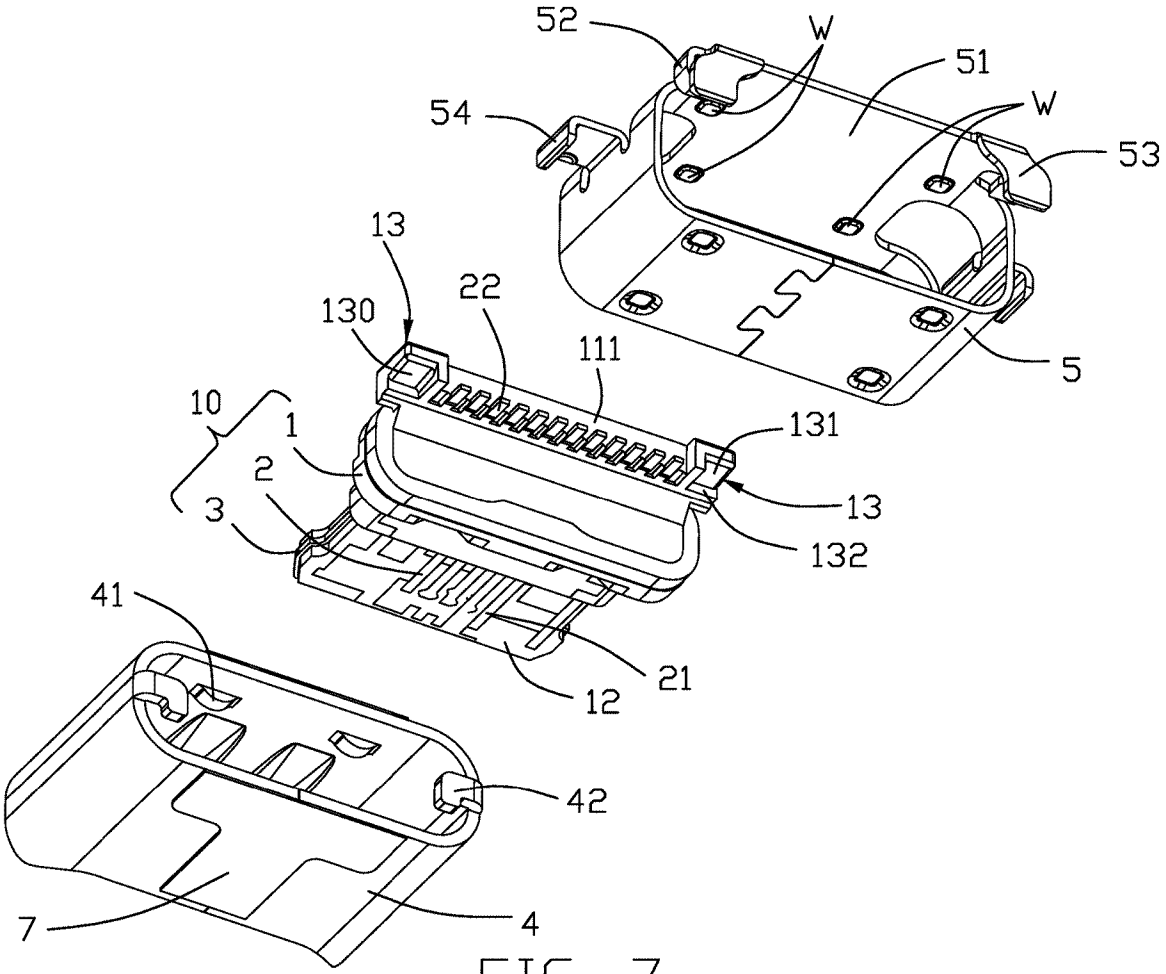
FIG. 7 is a rear upward exploded perspective view of the electrical connector of FIG. 5.

Referring to FIGS. 1-7, the electrical connector 100 adapted to be mounted to a printed circuit board (not shown), include s terminal module 10, a metallic tubular shield 4 enclosing the terminal module 10 to form a sub-assembly (not labeled), and a metallic tubular bracket 5 enclosing the sub-assembly, a glue 6 and a pair of waterproof film 7. The terminal module 10 includes an insulator 1, a plurality of terminals 2 and a metallic shielding plate 3 commonly disposed in the insulator 1.

The insulator 1 includes a base 11 and the tongue portion 12 forwadly extending from the base 11. The base 11 includes a front end 112 and a rear end 111 opposite to the front end 112. The front end 112 has recessions 1121. The rear end has a pair of securing sections 13, each securing section 13 forming a recess 131 and an abutment wall 132 in front of the recess 131. The recess 131 forms a downwardly slanted face 130 from back to front.

The terminal 2 includes a contacting section 21 and a soldering section 22. The soldering section 22 extends out of the insulator 1 from the rear end 111.

The shield 4 forms a plurality of protrusions 41 and a plurality of bulged regions 43, and a pair of stopping tabs 42.

The bracket 5 includes a top wall 51, a pair of L-shaped fixing sections 52 extending downwardly from two lateral sides of the top wall 51, a pair of securing tabs 53 adapted to be mounted to the printed circuit board for avoiding upward tilting of the electrical connector 100 during mating, and a pair of mounting legs 54 split from a main body of the bracket 5 and mounted to the corresponding holes in the printed circuit board.

The manufacturing method includes the following steps: (i) respectively forming the terminal module 10 with the corresponding terminals 2 and the shielding plate 3, the shield 4 with the pair of waterproof films 7, and the bracket 5 before assembling, wherein the terminal module 10 can be formed with at least one insert-molding process, and the shield 4 and the bracket 5 are formed by stamping and forming; (ii) forwardly assembling the terminal module 2 into the shield 4 along the front-to-back direction for forming a sub-assembly (not labeled) to have initially the protrusion 41 received within the corresponding recessions 1211 for preventing further forward movement of the terminal module 2 with regard to the shield 4, and successively the stopping tab 42 being deflected to its final position for preventing backward movement of the terminal module 2 with regard to the shield 4: (iii) forwardly assembling the completely preformed bracket 5 upon the sub-assembly along the front-to-back direction wherein the fixing section 52 guidably moves along the slanted face 130 in the recess 131 and finally abuts against the abutment wall 132 so as to have the bracket 5 fixed upon the sub-assembly without relative movements between the sub-assembly and the bracket 4 in all the front-to-back direction, the vertical direction and the transverse direction perpendicular to one another. The last step of manufacturing is to weld the bracket 5 upon the shield 4 around spots W and apply the glue 6 into a rear side of the sub-assembly.

Understandably, the bracket 5 is preformed with the corresponding fixing sections 52 in the final shape/position so as to be easily assembled upon the sub-assembly (not labeled), i.e., the combination of the terminal module 10 and the corresponding shield 4, by snapping into the corresponding recess 131 or engagement with the corresponding securing section 13 during the last stage of forwardly assembling upon the sub-assembly along the front-to-back direction. Differently, in the aforementioned copending application Ser. No. 15/169,963, the bracket is expected to have the corresponding fixing sections unfolded before assembling to the sub-assembly while being further bent/deformed after assembled to have the fixing section of the bracket grasp the corresponding securing section via additional operation process which takes more labor and more time and tending to damage if in an incautious situation. From a technical viewpoint, in the instant invention the bracket 5 is forwardly moved to the sub-assembly during assembling while in the aforementioned copending application, the corresponding bracket is rearwardly assembled to the sub-assembly differently.

Notably, even though in the invention the bracket 5 is completely preformed before assembling with the sub-assembly, oppositely the shield 4 is not completely preformed with the stopping tab 42 in an extended manner without deflection before assembled with the terminal module 10 but successively deflected to be located in its final position for preventing backward movement of the insulator 1 with regard to the shield 4 in the sub-assembly. In other words, in this embodiment the complete performing is only applied to the bracket 5 rather than both the shield 4 and the bracket 5. The slanted face 130 may gradually enhance the interference between the securing section 13 and the corresponding fixing section 52 during assembling until the last stage. Another feature of the invention and the aforementioned copending application is to provide the metallic shield in a circumferentially closed manner without any openings due to the mounting legs unitarily extending or split therefrom while the metallic bracket in a circumferentially open manner with mounting legs extending/split therefrom. Under this arrangement, the preferred EMI (Electro-Magnetic Interference) shielding effect may be obtained.

However, the disclosure is illustrative only, changes may be made in detail, especially in matter of shape, size, and arrangement of sections within the principles of the invention.

What is claimed is:

1. An electrical connector comprising:

a terminal module including an insulator with a plurality of terminals disposed therein;

a pair of securing sections formed around a rear end of the insulator in a front-to-back direction;

a metallic tubular shield enclosing the terminal module to commonly form a sub-assembly; and a metallic tubular bracket enclosing the sub-assembly with a pair of fixing sections formed around a rear portion thereof; wherein the pair of fixing sections are preformed before the bracket is forwardly assembled upon the sub-assembly in said front-to-back direction; and the securing section includes an abutment wall to prevent further forward movement of a corresponding fixing section.

2. The electrical connector as claimed in claim 1, wherein said bracket further includes a pair of securing tabs extending downwardly in a vertical direction perpendicular to said front-to-back direction around said pair of securing sections, respectively, said securing tabs located behind and adjacent to the pair of securing sections, respectively.

3. The electrical connector as claimed in claim 2, wherein said securing tabs are adapted to be soldered to a printed circuit board on which the connector is mounted.

4. The electrical connector as claimed in claim 1, wherein said bracket includes a top wall welded upon the shield.

5. The electrical connector as claimed in claim 4, wherein said fixing section includes an L-shaped structure extending downwardly from the top wall.

6. The electrical connector as claimed in claim 5, wherein said securing section forms a recess in which the fixing section is received.

7. The electrical connector as claimed in claim 1, wherein said insulator forms a pair of recessions, and the shield form a pair of protrusions received within the corresponding recessions, respectively, for preventing further forward movement of the insulator relative to the shield, and a pair of stopping tabs abutting against a rear side of the insulator for preventing rearward movement of the insulator with regard to the shield.

8. The electrical connector as claimed in claim 1, wherein said bracket is configured and dimension to allow the sub-assembly to be rearwardly assembled thereinto along the front-to-back direction.

9. The electrical connector as claimed in claim 1, wherein said shield is essentially in a circumferentially closed manner without openings while said bracket is essentially in a circumferentially open manner with openings due to mounting legs unitarily split and extending therefrom.

10. A method of making an electrical connector, comprising steps of:

providing a terminal module with an insulator and a plurality of terminals disposed therein, said insulator further including a pair of securing sections around a rear end;

rearwardly assembling a metallic tubular shield upon the terminal module to form a sub-assembly;

providing a metallic preformed tubular bracket with a pair of fixing sections around a rear portion; and forwardly assembling the bracket upon the sub-assembly to have the pair of fixing sections engaged with the pair of securing sections, respectively.

11. The method as claimed in claim 10, wherein said shield is essentially in a circumferentially closed manner while the bracket is essentially in a circumferentially open manner with openings due to mounting legs unitarily split and extending downwardly therefrom.

12. The method as claimed in claim 10, wherein said fixing section is of an L-shaped configuration, and said securing section forms a recess with an abutment wall in front of said recess.

13. The method as claimed in claim 10, further including a steps of welding the bracket to the shield.

14. The method as claimed in claim 10, wherein the shield forms a pair of protrusions, and the insulator forms a pair of recessions to receive the pair of protrusions therein to prevent further forward movement of the insulator relative to the shield, and said shield further include a pair of stopping tabs abutting against a rear side of the insulator to prevent further rearward movement of the insulator relative to the shield, wherein said stopping tabs extend from a top wall of the shield in an coplanar extended manner originally before the insulator is assembled with the shield while is downwardly deflected to final positions to abut against the rear side of the insulator after assembled with the insulator.

15. The method as claimed in claim 10, wherein said bracket further includes a pair of securing legs around a rear end thereof behind the pair of securing sections.

16. An electrical connector comprising:

a terminal module including an insulator with a plurality of terminals disposed therein;

a pair of securing sections formed around a rear end of the insulator in a front-to-back direction;

a metallic tubular shield enclosing the terminal module to commonly form a sub-assembly; and a metallic tubular bracket enclosing the sub-assembly with a pair of fixing sections formed around a rear portion thereof; wherein said shield is essentially in a circumferentially closed manner without openings while said bracket is essentially in a circumferentially open manner with openings due to mounting legs unitarily split and extending therefrom; and the shield forms a pair of protrusions, and the insulator forms a pair of recessions to receive the pair of protrusions therein to prevent further forward movement of the insulator relative to the shield, and said shield further includes a pair of stopping tabs abutting against a rear side of the insulator to prevent further rearward movement of the insulator relative to the shield.

17. The electrical connector as claimed in claim 16, wherein said bracket further includes a pair of securing tabs adapted to be secured to a printed circuit board and located behind and adjacent to the pair of securing sections, respectively.

18. The electrical connector as claimed in claim 17, wherein said mounting legs are located around a middle portion of the connector while said pair of securing tabs are located around a rear end of the connector.

* * * * *